US009770925B2

(12) United States Patent
Hamano

(10) Patent No.: US 9,770,925 B2
(45) Date of Patent: Sep. 26, 2017

(54) RECORDING APPARATUS AND WINDING METHOD

(71) Applicant: SEIKO EPSON CORPORATION, Tokyo (JP)

(72) Inventor: Ryo Hamano, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/240,907

(22) Filed: Aug. 18, 2016

(65) Prior Publication Data

US 2017/0050452 A1 Feb. 23, 2017

(30) Foreign Application Priority Data

Aug. 19, 2015 (JP) ..... 2015-161684

(51) Int. Cl.
*B41J 15/16* (2006.01)
*B65H 23/195* (2006.01)

(52) U.S. Cl.
CPC ..... *B41J 15/16* (2013.01); *B65H 23/1955* (2013.01)

(58) Field of Classification Search
CPC ..... B41J 15/16; B65H 23/1955
See application file for complete search history.

(56) References Cited

U.S. PATENT DOCUMENTS

2010/0194812 A1* 8/2010 Castells ..... B41J 29/38 347/16
2014/0239113 A1* 8/2014 Igarashi ..... B65H 23/1825 242/420.5
2015/0225196 A1 8/2015 Hamano et al.

FOREIGN PATENT DOCUMENTS

JP 2006-151651 6/2006

* cited by examiner

*Primary Examiner* — Julian Huffman
(74) *Attorney, Agent, or Firm* — Workman Nydegger

(57) ABSTRACT

A printer includes a transportation unit that transports roll paper, a winding unit that winds up the transported roll paper, and a controller that controls the transportation unit and the winding unit. The controller switches between thresholds for a torque limit of the winding unit on the basis of inertia of the winding unit and a speed at which the roll paper is transported when the winding unit winds up the roll paper in synchronization with a transportation operation of the transportation unit.

5 Claims, 5 Drawing Sheets

RECORDING APPARATUS AND WINDING METHOD

BACKGROUND

1. Technical Field

The present invention relates to a recording apparatus and a method of winding up a recording medium.

2. Related Art

Recording apparatuses have been used which include a winding unit that winds up a recording medium on which data has been recorded by a recording unit. For example, JP-A-2006-151651 discloses a recording apparatus including a movable tension roller that applies tension to a recording medium on which data has been recorded. This recording apparatus is capable of correcting a winding speed depending on the position of the tension roller.

Upon winding up a recording medium, there are cases where the likelihood of trouble (such as uneven winding and twists) occurring upon winding up a recording medium can be reduced by applying tension to the recording medium while winding.

When a movable tension roller such as that disclosed in JP-A-2006-151651 is used, however, there are cases where it is difficult to apply desired tension to a recording medium (and to maintain the recording medium under the desired tension) due to movement of the tension roller. If the desired tension is not applied to the recording medium, there are cases where the wound-up recording medium has wrinkles, winding misalignment, or slack, or the recorded image has banding (band unevenness) or the like. Therefore, it is desirable to apply tension to a recording medium without using the movable tension roller when winding up the recording medium, and it is desirable to reduce the likelihood of trouble occurring upon winding up a recording medium by applying desired tension to the recording medium.

SUMMARY

An advantage of some aspects of the invention is that it is possible to reduce the likelihood of trouble occurring upon winding up a recording medium. It is possible to implement the invention in the following application examples or embodiments.

APPLICATION EXAMPLE 1

A recording apparatus according to this application example includes a transportation unit that transports a recording medium, a winding unit that winds up the transported recording medium, and a controller that controls the transportation unit and the winding unit. The controller switches between thresholds for a torque limit of the winding unit on the basis of inertia of the winding unit and a speed at which the recording medium is transported when the winding unit winds up the recording medium in synchronization with a transportation operation of the transportation unit.

According to this application example, the controller controls the winding by switching between the thresholds for the torque limit of the winding unit on the basis of the inertia (moment of inertia) of the winding unit and the speed at which the recording medium is transported when the winding unit winds up the recording medium in synchronization with the transportation operation of the transportation unit. As a result, the torque of the winding unit is controlled to have a more appropriate value in synchronization with the transportation operation of the transportation unit, and therefore it is possible to apply desired tension to a recording medium with increased stability and reduce the likelihood of trouble such as uneven winding and twists occurring upon winding up a recording medium.

APPLICATION EXAMPLE 2

In the recording apparatus according to the above application example, the inertia of the winding unit includes inertia of the recording medium wound up by the winding unit.

According to this application example, the inertia of the winding unit includes inertia of the recording medium wound up by the winding unit, and therefore the torque of the winding unit is controlled to have a more appropriate value from the start to the end of the winding. As a result, it is possible to apply desired tension to a recording medium with increased stability and reduce the likelihood of trouble such as uneven winding and twists occurring upon winding up a recording medium.

APPLICATION EXAMPLE 3

In the recording apparatus according to the above application example, the controller corrects the thresholds for the torque limit of the winding unit on the basis of a difference between a speed at which the transportation unit transports the recording medium and a speed at which the winding unit winds up the recording medium.

According to this application example, the controller corrects the thresholds for the torque limit of the winding unit on the basis of the difference between the speed at which the transportation unit transports the recording medium and the speed at which the winding unit winds up the recording medium, and therefore the transportation operation of the transportation unit and a winding operation of the winding unit can be executed in synchronization with increased accuracy. As a result, it is possible to apply desired tension to a recording medium with increased stability and reduce the likelihood of trouble such as uneven winding and twists occurring upon winding up a recording medium.

APPLICATION EXAMPLE 4

In the recording apparatus according to the above application example, the transportation unit intermittently transports the recording medium by repetitively performing the transportation operation, and the controller corrects the thresholds for the torque limit of the winding unit on the basis of a difference between a transportation length and a winding length, the transportation length being a length of a path through which the transportation unit transports the recording medium in one execution of the transportation operation, the winding length being a length of the recording medium which the winding unit winds up in synchronization with the transportation operation of the transportation unit.

According to this application example, the controller corrects the thresholds for the torque limit of the winding unit on the basis of the difference between the transportation length, which is a length of a path through which the transportation unit transports the recording medium in one execution of the transportation operation, and the winding length, which is a length of the recording medium which the winding unit winds up in synchronization with the transportation operation of the transportation unit, and therefore, the transportation operation of the transportation unit and the winding operation of the winding unit can be executed in synchronization with increased accuracy. As a result, it is possible to apply desired tension to a recording medium with increased stability and reduce the likelihood of trouble such as uneven winding and twists occurring upon winding up a recording medium.

APPLICATION EXAMPLE 5

A winding method according to this application example is a method of winding up a recording medium in a recording apparatus including a transportation unit that transports the recording medium and a winding unit that winds up the transported recording medium, the method including switching between thresholds for a torque limit of the winding unit on the basis of inertia of the winding unit and a speed at which the recording medium is transported when the winding unit winds up the recording medium in synchronization with a transportation operation of the transportation unit.

According to this application example, the thresholds for the torque limit of the winding unit are switched from one to another on the basis of the inertia of the winding unit and the speed at which the recording medium is transported when the winding unit winds up the recording medium in synchronization with the transportation operation of the transportation unit. As a result, the torque of the winding unit becomes a more appropriate value in synchronization with the transportation operation of the transportation unit, and therefore it is possible to apply desired tension to a recording medium with increased stability and reduce the likelihood of trouble such as uneven winding and twists occurring upon winding up a recording medium.

APPLICATION EXAMPLE 6

In the winding method according to the above application example, the thresholds for the torque limit of the winding unit are corrected on the basis of a difference between a speed at which the transportation unit transports the recording medium and a speed at which the winding unit winds up the recording medium.

According to this application example, the thresholds for the torque limit of the winding unit are corrected on the basis of the difference between the speed at which the transportation unit transports the recording medium and the speed at which the winding unit winds up the recording medium, and therefore the transportation operation of the transportation unit and the winding operation of the winding unit can be executed in synchronization with increased accuracy. As a result, it is possible to apply desired tension to a recording medium with increased stability and reduce the likelihood of trouble such as uneven winding and twists occurring upon winding up a recording medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
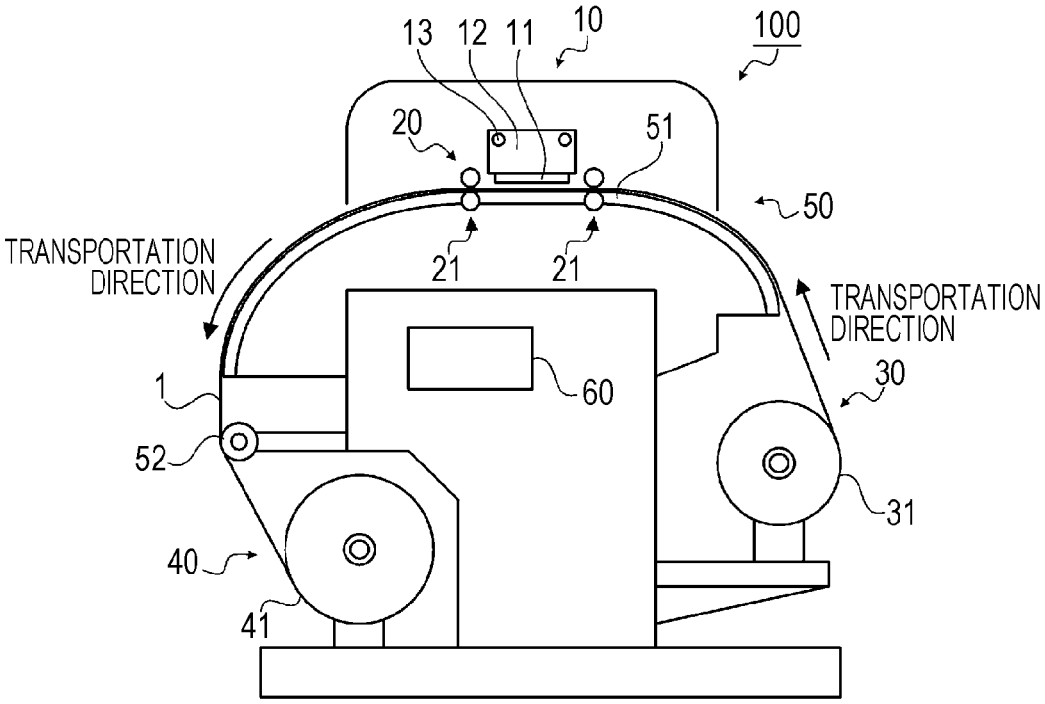
FIG. 1 is a schematic side view of a recording apparatus according to Embodiment 1.

Hereinafter, embodiments that embody the invention will be described with reference to the drawings. Each of the following embodiments is merely an example of the invention and does not limit the invention. Note that there are cases where dimensions in the drawings referred to below are different from actual dimensions in order to facilitate description.

Embodiment 1

Recording Apparatus (Printer)

Figure 2:
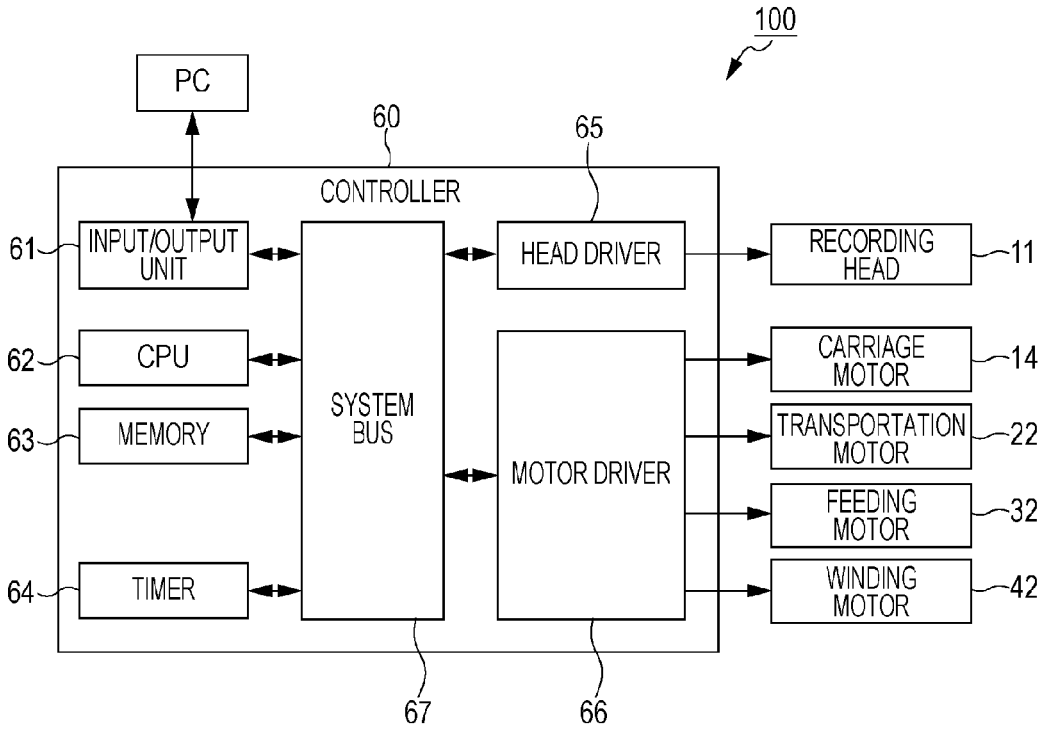
FIG. 2 is a block diagram of a recording apparatus according to Embodiment 1.

FIG. 1 is a schematic side view of a printer 100 as a "recording apparatus" according to Embodiment 1. FIG. 2 is a block diagram of the printer 100.

The printer 100 is an ink jet printer that records (prints) an image on roll paper 1 which is wound into a roll and fed as a "recording medium" to the printer 100.

The printer 100 includes a recording unit 10, a transportation unit 20, a feeder 30, a winding unit 40, a transportation path 50, and a controller 60.

Roll paper 1 is fed from the feeder 30, passes through the transportation path 50 via the recording unit 10 as a recording operation is executed, and is stored in the winding unit 40.

For example, high-quality paper, cast paper, art paper, coated paper, synthetic paper, or a film made of PET (polyethylene terephthalate), PP (polypropylene), or the like can be used as the roll paper 1.

The recording unit 10 includes a recording head 11, a carriage 12, a guide shaft 13, and other components. The recording head 11 is an ink jet head including a plurality of nozzles that discharge ink. The guide shaft 13 extends in a scanning direction intersecting a transportation direction in which the roll paper 1 travels. The recording head 11 is mounted on the carriage 12. The carriage 12 is made to reciprocate (make a scanning movement) along the guide shaft 13 by a carriage motor 14 (refer to FIG. 2) which is driven and controlled by the controller 60.

The controller 60 forms (records) a desired image on the roll paper 1 by alternating between an operation of discharging ink droplets from the recording head 11 while moving the carriage 12 in the scanning direction and a transportation operation in which the transportation unit 20 moves the roll paper 1 in the transportation direction. In other words, when an image is recorded on the roll paper 1, the transportation unit 20 intermittently transports the roll paper 1 by repetitively performing the transportation operation.

Note that the recording unit 10 is configured to use a serial head which reciprocates in the scanning direction as described above, but may instead be configured to use a line head in which nozzles that discharge ink are arranged over a width range of the roll paper 1 in a direction intersecting the transportation direction. Furthermore, the recording apparatus may include a recording unit other than a recording unit including such an ink jet recording head as described above.

The transportation unit 20 is a transporting mechanism that moves the roll paper 1 in the transportation direction in the recording unit 10, and includes, for example, a drive roller 21 provided with a nip roller. The drive roller 21 is driven in a state where the roll paper 1 is pinched between the drive roller 21 and the nip roller, and thus the roll paper 1 is transported at a speed corresponding to the circumferential speed of the drive roller 21. This means that the circumferential speed of the drive roller 21 is equal to the transportation speed of the roll paper 1, for example, when there is no expansion or contraction of the roll paper 1 or when there is no slippage between the drive roller 21 and the roll paper 1.

The drive roller 21 is driven by a transportation motor 22 (refer to FIG. 2) which is driven and controlled by the controller 60. Furthermore, a rotary encoder is provided on the drive roller 21.

Note that the transportation unit 20 is not limited to a configuration including the rollers described above, but may, for example, be formed of a transportation belt or the like.

The feeder 30 is a storage unit for storing the roll paper 1 on which an image has not yet been recorded. The feeder 30 is located upstream of the recording unit 10 in the transportation path 50, and includes a feeding reel 31 or the like.

The feeding reel 31 is rotated by a feeding motor 32 (refer to FIG. 2), which is driven and controlled by the controller 60, and feeds the roll paper 1 toward the recording unit 10 located downstream of the feeder 30.

The winding unit 40 is a storage unit that winds up the roll paper 1 on which an image has been recorded and stores the roll paper 1 wound into a roll. The winding unit 40 is located downstream of the recording unit 10 in the transportation path 50, and includes a winding reel 41 and other components.

The winding reel 41 has a rotation shaft that is rotated by a winding motor 42 (refer to FIG. 2), which is driven and controlled by controller 60, and winds up the roll paper 1 transported thereto via the recording unit 10, with the rotation shaft functioning as a core thereof. A rotary encoder is provided on the rotation shaft.

The transportation path 50 is a transportation route in which the roll paper 1 is transported from the feeder 30 to the winding unit 40 via the recording unit 10, and includes a medium support 51, a rotary bar member 52, and other components. The medium support 51 includes a platen that supports the roll paper 1 in a recording region of the recording unit 10.

The rotary bar member 52 extends over a width range of the roll paper 1, between the winding unit 40 and a downstream end of the transportation route formed with the medium support 51. The rotation shaft of the rotary bar member 52 is fixed to and supported by the main body of the printer 100. The rotary bar member 52 is rotated following the movement of the roll paper 1 abutting the rotary bar member 52, to support the movement of the roll paper 1.

The controller 60 includes, for example, an input/output unit 61, a CPU (central processing unit) 62, a memory 63, a timer 64, a head driver 65, a motor driver 66, and a system bus 67, as illustrated in FIG. 2, and performs centralized control over the entire printer 100.

The input/output unit 61 exchanges data between an external device, such as a personal computer (PC), and the printer 100.

The CPU 62 is an arithmetic processing unit for controlling the entire printer 100, and is connected to the input/output unit 61, the memory 63, the timer 64, the head driver 65, and the motor driver 66 via the system bus 67.

The memory 63 is an area in which a program which the CPU 62 executes is stored and in which necessary information is recorded. The memory 63 is formed of a storage device such as a random-access memory (RAM), a read-only memory (ROM), or a flash memory.

The CPU 62 controls the head driver 65 and the motor driver 66 in accordance with, for example, a program stored in the memory 63 and a recording job (a print command) received from an external device.

The controller 60 is capable of recognizing, for example, a travel distance and a transportation speed of the roll paper 1 in the transportation unit 20 and a travel distance and a winding speed of the roll paper 1 in the winding unit 40 from values read by the rotary encoders provided on the transportation unit 20 and the winding unit 40. Note that laser Doppler velocimeters or the like may be provided on the transportation unit 20 and the winding unit 40 to measure these travel distances and speeds.

The controller 60 switches between thresholds for a torque limit of the winding unit 40 on the basis of inertia (moment of inertia) of the winding unit 40 and a speed at which the roll paper 1 is transported when the winding unit 40 winds up the roll paper 1 in synchronization with a transportation operation of the transportation unit 20.

The drive timing of the transportation unit 20 (the drive roller 21) and the winding unit 40 (the winding reel 41), the threshold for the torque limit, the torque of the winding unit 40, and the like, for winding up the roll paper 1 will be described below in detail.

Note that the printer 100 is capable of transporting the roll paper 1 in the opposite direction as the transportation direction. In this case, "the relationship between the drive timing of the transportation unit 20 and the feeding reel 31, the threshold for the torque limit, and the torque of the feeding reel 31 for transporting the roll paper 1 in the opposite direction" is the same as or similar to "the relationship between the drive timing of the transportation unit 20 and the winding reel 41 (the winding unit 40), the threshold for the torque limit, and the torque of the winding reel 41 for winding up the roll paper 1." This means that the description below is also applied to "the relationship between the drive timing of the transportation unit 20 and the feeding reel 31, the threshold for the torque limit, and the torque of the feeding reel 31 for transporting the roll paper 1 in the opposite direction".

Method of Winding Up Roll Paper

Figure 3A:
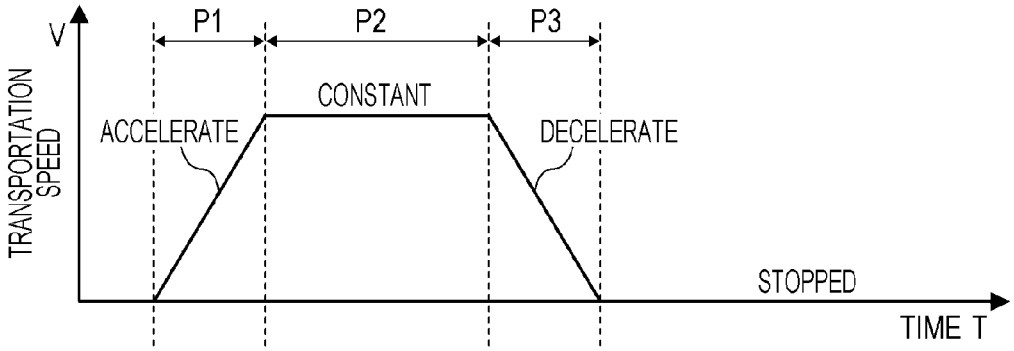
FIGS. 3A to 3C are time charts at winding of a recording medium.
Figure 3B:
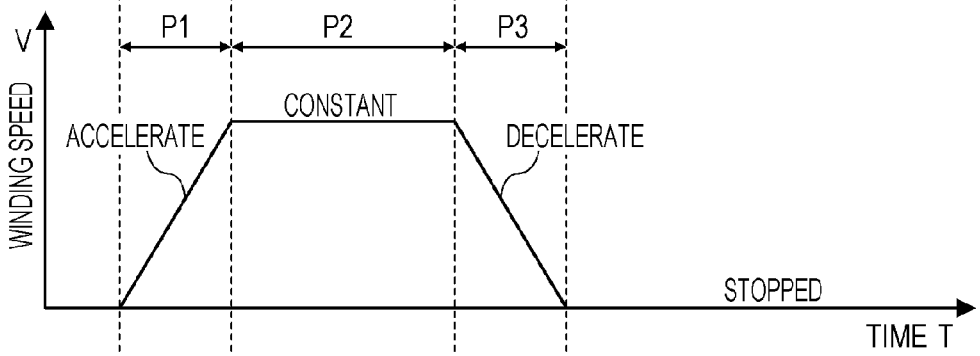
Figure 3C:
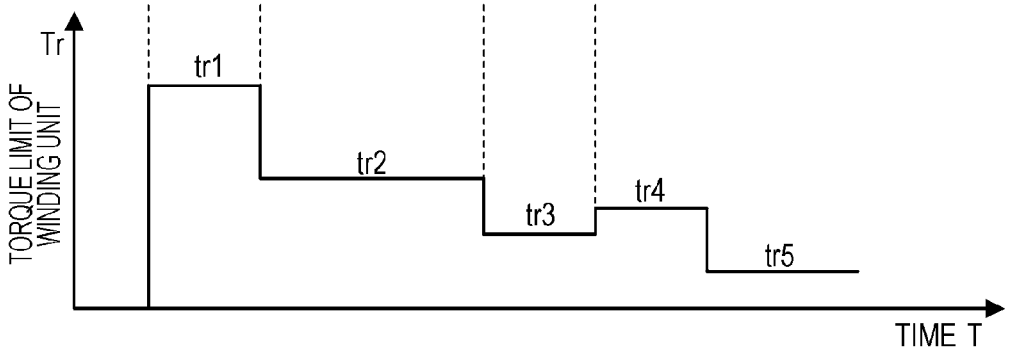

FIGS. 3A to 3C are time charts at winding of the roll paper 1. FIG. 3A illustrates a change over time of the transportation speed of the transportation unit 20. FIG. 3B illustrates a change over time of the winding speed of the winding unit 40. FIG. 3C illustrates a change over time of the threshold for the torque limit of the winding reel 41.

When an image is recorded on the roll paper 1, the transportation unit 20 intermittently transports the roll paper 1 by repetitively performing the transportation operation as described above. FIGS. 3A to 3C are time charts illustrating one execution of this repetitive transportation operation.

The winding method according to the present embodiment is achieved by controlling the winding motor 42 and the transportation motor 22.

The circumferential speed of the roll paper 1 is equal to the winding speed of the roll paper 1, for example, when there is no expansion or contraction of the roll paper 1 or when there is no slippage between the rotation shaft of the winding reel 41 and the roll paper 1. The winding speed of the roll paper 1 is equal to the transportation speed of the roll paper 1 in the transportation unit 20 when there is no expansion or contraction of the roll paper 1.

First, when starting (or resuming) transportation and winding in the repetitive transportation operation, the controller 60 drives the drive roller 21 and the winding reel 41 so that an accelerating drive P1 of the transportation unit 20 and an accelerating drive R1 of the winding unit 40 are in synchronization with each other. The threshold for the torque limit of the winding reel 41 at this time is set to a threshold tr1 by the controller 60.

The driving of the winding reel 41 is controlled by the controller 60 in accordance with a predetermined maximum torque (a torque limit set to the threshold for the torque limit) and a predetermined maximum speed. Therefore, the winding reel 41 is driven on the basis of the maximum torque when the torque of the winding reel 41 has reached the maximum torque, whereas the winding reel 41 is accelerated up to a ceiling of the maximum speed when the torque of the winding reel 41 has not reached the maximum torque.

Furthermore, the controller 60 drives the drive roller 21 and the winding reel 41 so that the roll paper 1 is transported and wound up while tension along the transportation direction is applied to the roll paper 1. Specifically, the controller 60 controls the transportation unit 20 (transportation motor 22) and the winding unit 40 (the winding motor 42) so that the winding speed at which the winding reel 41 winds up the roll paper 1 is higher than the transportation speed at which the drive roller 21 transports the roll paper 1.

Next, when the transportation speed reaches a predetermined speed, the controller 60 changes a drive mode of the transportation unit 20 from the accelerating drive P1 to a constant speed drive P2, and changes a drive mode of the winding unit 40 from the accelerating drive R1 to a constant speed drive R2. At the same time, the controller 60 switches the threshold for the torque limit of the winding reel 41 from the threshold tr1 to a threshold tr2.

Next, in order to complete predetermined transportation, the controller 60 changes the drive mode of the transportation unit 20 from the constant speed drive P2 to a decelerating drive P3, and changes the drive mode of the winding unit 40 from the constant speed drive R2 to a decelerating drive R3. At the same time, the controller 60 switches the threshold for the torque limit of the winding reel 41 from the threshold tr2 to a threshold tr3.

Next, the controller 60 stops driving the transportation unit 20 and the winding unit 40, and increases the threshold for the torque limit of the winding reel 41 from the threshold tr3 to a threshold tr4 simultaneously, and then decreases the threshold to a threshold tr5. Once the threshold for the torque limit is increased up to the threshold tr4, if there is slack in the roll paper 1 wound on the winding unit 40, such slack can be taken up. Furthermore, it is possible to prevent the roll paper 1 from becoming slack by maintaining the threshold for the torque limit at the threshold tr5. Thus, a torque is continuously given to the winding motor 42 even when the winding motor 42 is in a stopped state.

Calculation of Threshold for Torque Limit

The threshold tr for the torque limit is calculated using the following method depending on tension F that activates the torque-limiting function (that is, tension F with the maximum torque).

First, in an initial state, rotational loads on the winding reel 41 (specifically, electrical-current values required to rotate the winding reel 41) at two different rotational speeds, i.e., a low rotational speed and a high rotational speed, are measured to determine the relationship between the rotational speeds and the rotational loads with respect to periods of the encoder provided on the winding reel 41.

The measured low rotational speed and the measured high rotational speed are denoted by x1 and x2, respectively.

Next, an average rotational load, also at each of the two different low and high rotational speeds of the winding reel 41, is calculated using a proportional-integral-derivative controller (a PID controller). The measured average rotational load at the low rotational speed and the measured average rotational load at the high rotational speed are denoted by y3 and y4, respectively. The roll outside diameter of the roll paper 1 that has been wound is denoted by D, and the rotational speed of the winding reel 41 is denoted by X. The threshold tr for the torque limit is determined by the following Equation 1. In this equation, K is a coefficient for converting a torque corresponding to the tension F into the torque limit.

Note that in the case where the winding reel 41 is driven and controlled by controlling voltages, the rotational load may be a voltage value.

$$tr = F \times D/2 \times K + \frac{(y4 - y3)}{(x2 - x1)} \times X + y3 - \frac{(y4 - y3) \times x1}{(x2 - x1)} \quad \text{(Equation 1)}$$

Furthermore, in the present embodiment, the threshold tr for the torque limit is determined in consideration of the inertia of the winding unit 40. Specifically, in consideration of the inertia of the winding unit 40, the tension F that enables the torque limit to function is determined, and the threshold tr for the torque limit is determined using the determined tension F.

The considered inertia of the winding unit 40 includes not only the inertia of a driven system such as the winding reel 41 which includes the winding motor 42, but also the inertia of the roll paper 1 wound up by the winding unit 40. The considered inertia of the roll paper 1 depends on the amount of the roll paper 1 wound up by the winding unit 40 (the roll outside diameter D).

The tension F determined in consideration of the inertia of the winding unit 40 can be determined according to the following Equation 2.

$$F = Ka/D^2 + Kb \times D^2 - Kc/D^2 - Kd \quad \text{(Equation 2)}$$

In Equation 2, Ka to Kd are coefficients necessary for the calculation. The first term of Equation 2 represents the contribution of the inertia of the winding unit 40 as the driven system, and the second and subsequent terms of Equation 2 represent the contribution of the inertia of the roll paper 1 wound up by the winding unit 40. Coefficients kb to Kd in the second and subsequent terms are determined in accordance with the specifications of the roll paper 1 (such as mass, density, thickness, and width).

Figure 4:
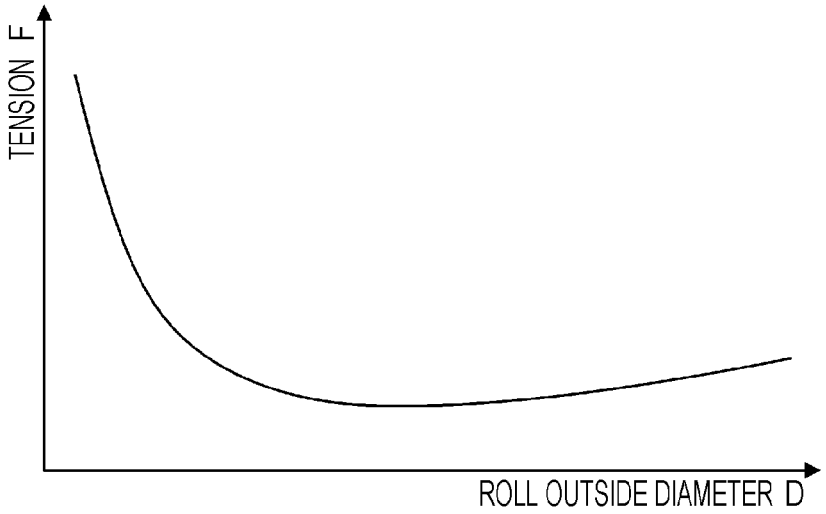
FIG. 4 is a graph illustrating the relationship between a roll outside diameter of a recording medium and tension applied to the recording medium.

FIG. 4 is a graph illustrating the relationship between the roll outside diameter D of the roll paper 1 wound up by the winding unit 40 and the tension F applied to the roll paper 1 on the winding unit 40.

It is understood that the required tension F increases as a result of an increase in the inertia of the roll paper 1 when the roll outside diameter D is greater than or equal to a certain value (the median on the horizontal axis of the graph), that is, when the amount of the roll paper 1 wound up by the winding unit 40 is greater than or equal to the certain value.

The threshold tr for the torque limit is calculated as desired, for example, in a short cycle of 1 microsecond to 1 millisecond, according to Equation 2 and Equation 1 described above. When the controller 60 determines that the threshold for the torque limit is to be switched, the threshold tr for the torque limit calculated immediately before the determination is used. Specifically, the controller 60 performs the control of switching between the thresholds for the torque limit using the threshold tr for the torque limit calculated at the point in time closest to a timing of a change in the speed of the transportation unit 20, such as a change from an acceleration to a constant speed, a change from a constant speed to a deceleration, and a change from a deceleration to a stopped state, represented by transitions between driven states P1, P2, and P3 illustrated in FIG. 3A, and a change in the degree of acceleration or deceleration.

Correction of Threshold for Torque Limit

Next, correction of the threshold for the torque limit will be described.

There are cases where correction is required even when the threshold for the torque limit is calculated and applied in consideration of the inertia of the winding unit 40 as described above. This is because the inertia of the winding unit 40 as the driven system changes with variations in grease viscosity, and the inertia of the roll paper 1 wound up by the winding unit 40 changes with variations in the specifications of the roll paper 1 or depending on the eccentricity of the roll paper 1, for example.

Regarding the specifications of the roll paper 1, the printer 100 refers to specifications of the roll paper 1 to determine the coefficients K and Ka to Kd in advance for calculating the threshold for the torque limit. While the printer 100 calculates the threshold for the torque limit on the basis of the determined coefficients K and Ka to Kd, there are cases where the specifications of the roll paper actually used by a user for recording (printing) is different from the specifications which were previously expected.

Such a difference between the expected inertia and the actual inertia leads to a difference between the expected behavior and the actual behavior, and therefore the printer 100 dynamically corrects the threshold for the torque limit in the repetitive transportation operation.

Several methods are available for the correction. Two of such methods will be described below.

Correction Method 1

The first method is a correction method based on a difference between transportation speed of the transportation unit 20 and winding speed of the winding unit 40.

The controller 60 corrects the threshold for the torque limit of the winding unit 40 on the basis of a difference between the speed at which the transportation unit 20 transports the roll paper 1 and the speed at which the winding unit 40 winds up the roll paper 1.

Figure 5:
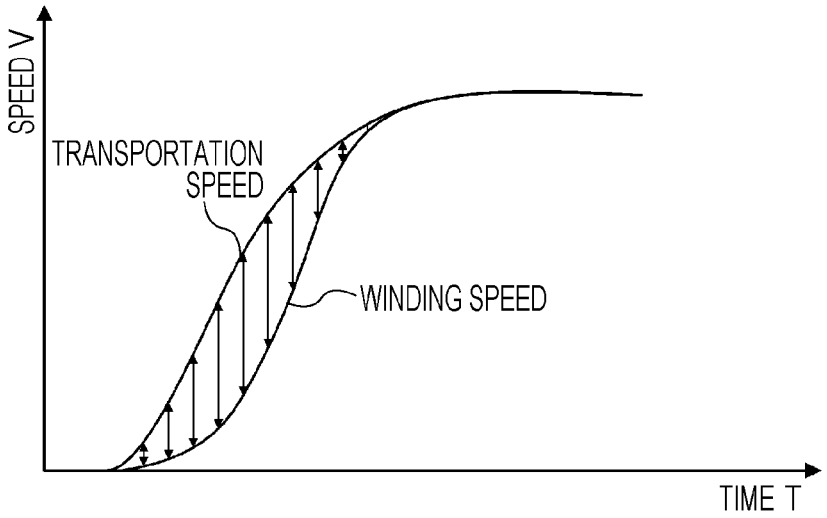
FIG. 5 is a graph illustrating a difference between a transportation speed of a transportation unit and a winding speed of a winding unit.

FIG. 5 is a graph illustrating a difference in the speed between the accelerating drive P1 of the transportation unit 20 and the accelerating drive R1 of the winding unit 40. FIG. 5 illustrates an example of a case where there is a delay in the winding by the winding unit 40 due to the inertia of the roll paper 1 being greater than expected inertia. In this case, the roll paper 1 tends to slack, and therefore the threshold for the torque limit is corrected upward.

Specifically, in order to reduce a difference between the speeds obtained from the encoders provided on portions of respective units, the controller 60 adds to (or subtracts from) the threshold for the torque limit to be applied, an excess or deficiency of torque based on the difference in the speeds. The torque to be added (or subtracted) for the correction is prepared in advance in the form of a function or correspondence table relating a speed and a difference in the speeds.

Regarding timing of the correction, the following approaches are available: one is that a series of operations in which the controller 60 recognizes a difference in the speeds, calculates a corresponding addition amount of torque, and applies the calculation result to the winding unit 40 is repeatedly performed as a cycle as desired; and another is that in each execution of the repetitive transportation operation, differences in the speeds are accumulated, and an excess or deficiency of torque corresponding to the total accumulated differences in the speeds is added to (or subtracted from) the threshold for the torque limit in the next transportation operation.

Correction Method 2

The second method is a correction method based on a difference between a transportation length by the transportation unit 20 and a winding length by the winding unit 40.

The controller 60 corrects the threshold for the torque limit of the winding unit 40 on the basis of a difference between the transportation length, which is a length of a path through which the transportation unit 20 transports the roll paper 1 in one execution of the transportation operation, and the winding length, which is a length of the roll paper 1 which the winding unit 40 winds up in synchronization with the transportation operation of the transportation unit 20.

Figure 6:
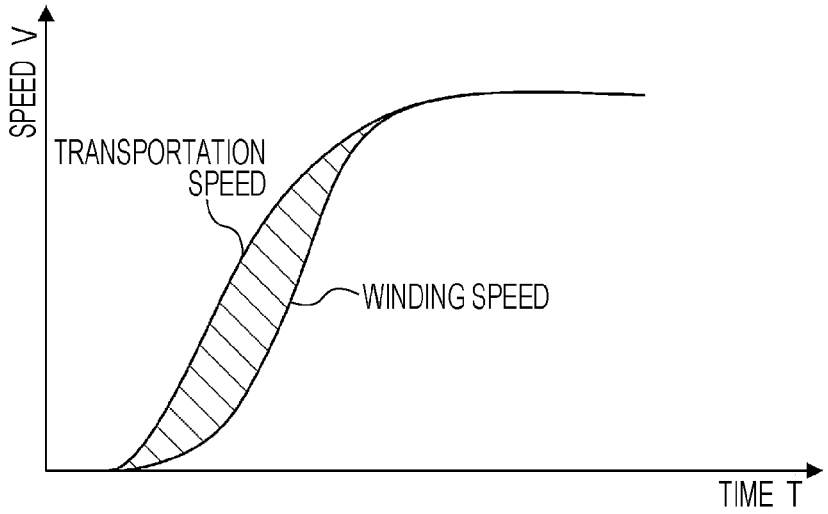
FIG. 6 is a graph illustrating a difference between a transportation speed of a transportation unit and a winding speed of a winding unit.

Similarly to FIG. 5, FIG. 6 is a graph illustrating a difference in the speed between the accelerating drive P1 of the transportation unit 20 and the accelerating drive R1 of the winding unit 40.

A difference between the transportation length by the transportation unit 20 and the winding length by the winding unit 40 is obtained by the controller 60, not only as a difference in the travel distances of the roll paper 1, obtained from the encoders provided on portions of respective units, but also as an area that is an integral of the difference in the speeds as illustrated in the portion indicated by the diagonal lines in FIG. 6.

In order to reduce a difference between the transportation length by the transportation unit 20 and the winding length by the winding unit 40, the controller 60 adds to (or subtracts from) the threshold for the torque limit to be applied, an excess or deficiency of torque based on the difference in the speeds. The torque added (or subtracted) for the correction is prepared in advance in the form of a function or correspondence table relating a speed and a difference between the transportation length by the transportation unit 20 and the winding length by the winding unit 40.

The correction is performed such that a difference is determined in each execution of the repetitive transportation operation, and an excess or deficiency of torque corresponding to the difference is added to the threshold for the torque limit in the next transportation operation.

Note that even when the winding speed of the winding unit 40 is greater than the transportation speed of the transportation unit 20, the correction can be performed in the same manner or in a similar manner on the basis of the detected difference between the transportation speed and the winding speed resulting from, for example, expansion or contraction of the roll paper 1 and mechanical backlash in the transportation route.

Although the above-described example is the case of the accelerating drive, the same correction or a similar correction is applicable in the case of the decelerating drive.

The method of winding up a recording medium (the roll paper 1) according to the present embodiment is specifically a method of calculating and applying the threshold for the torque limit and a method of correcting the threshold for the torque limit. The above-described disclosure describes the methods.

As described above, the recording apparatus and the winding method according to the present embodiment produce the following advantageous effects.

The controller 60 switches between thresholds for the torque limit of the winding unit 40 on the basis of the inertia (moment of inertia) of the winding unit 40 and the speed at which the roll paper 1 is transported when the winding unit 40 winds up the roll paper 1 in synchronization with the transportation operation of the transportation unit 20. As a result, the torque of the winding unit 40 is controlled to have a more appropriate value in synchronization with the transportation operation of the transportation unit 20, and therefore it is possible to apply desired tension to the roll paper 1 with increased stability and reduce the likelihood of trouble such as uneven winding and twists occurring upon winding up the roll paper 1.

The inertia of the winding unit 40 includes inertia of the roll paper 1 wound up by the winding unit 40, and therefore the torque of the winding unit 40 is controlled to have a more appropriate value from the start to the end of the winding. As a result, it is possible to apply desired tension to the roll paper 1 with increased stability and reduce the likelihood of trouble such as uneven winding and twists occurring upon winding up the roll paper 1.

According to correction method 1, the controller 60 corrects the threshold for the torque limit of the winding unit 40 on the basis of a difference between the speed at which the transportation unit 20 transports the roll paper 1 and the speed at which the winding unit 40 winds up the roll paper 1, and therefore the transportation operation of the transportation unit 20 and the winding operation of the winding unit 40 can be executed in synchronization with increased accuracy. As a result, it is possible to apply desired tension to the roll paper 1 with increased stability and reduce the likelihood of trouble such as uneven winding and twists occurring upon winding up the roll paper 1.

According to correction method 2, the controller 60 corrects the threshold for the torque limit of the winding unit 40 on the basis of a difference between the transportation length, which is a length of a path through which the transportation unit 20 transports the roll paper 1 in one execution of the transportation operation, and the winding length, which is a length of the roll paper 1 which the winding unit 40 winds up in synchronization with the transportation operation of the transportation unit 20, and therefore the transportation operation of the transportation unit 20 and the winding operation of the winding unit 40 can be executed in synchronization with increased accuracy. As a result, it is possible to apply desired tension to the roll paper 1 with increased stability and reduce the likelihood of trouble such as uneven winding and twists occurring upon winding up the roll paper 1.

This application claims priority under 35 U.S.C. §119 to Japanese Patent Application No. 2015-161684, filed Aug. 19, 2015. The entire disclosure of Japanese Patent Application No. 2015-161684 is hereby incorporated herein by reference.

What is claimed is:

1. A recording apparatus comprising:

a transportation unit that transports a recording medium, the transportation unit intermittently transports the recording medium by repetitively performing a transportation operation;

a winding unit that winds up the transported recording medium; and a controller that controls the transportation unit and the winding unit, wherein the controller switches between thresholds for a torque limit of the winding unit, the thresholds for torque limit being based on the inertia of the winding unit and a speed at which the recording medium is transported when the winding unit winds up the recording medium in synchronization with the transportation operation of the transportation unit, the controller corrects the thresholds for the torque limit of the winding unit on the basis of a difference between a transportation length and a winding length, the transportation length being a length of a path through which the transportation unit transports the recording medium in one execution of the transportation operation, the winding length being a length of the recording medium which the winding unit winds up in synchronization with the transportation operation of the transportation unit.

2. The recording apparatus according to claim 1, wherein the inertia of the winding unit includes inertia of the recording medium wound up by the winding unit.

3. The recording apparatus according to claim 1, wherein the controller corrects the thresholds for the torque limit of the winding unit on the basis of a difference between a speed at which the transportation unit transports the recording medium and a speed at which the winding unit winds up the recording medium.

4. A method of winding up a recording medium in a recording apparatus including a transportation unit that transports the recording medium and a winding unit that winds up the transported recording medium, the method comprising repetitively performing a transportation operation to intermittently transport the recording medium, switching between thresholds for a torque limit of the winding unit, the thresholds for torque limit being based on the inertia of the winding unit and a speed at which the recording medium is transported when the winding unit winds up the recording medium in synchronization with a transportation operation of the transportation unit, and correcting the thresholds for the torque limit of the winding unit on the basis of a difference between a transportation length and a winding length, the transportation length being a length of a path through which the transportation unit transports the recording medium in one execution of the transportation operation, the winding length being a length of the recording medium which the winding unit winds up in synchronization with the transportation operation of the transportation unit.

5. The method according to claim 4, wherein the thresholds for the torque limit of the winding unit are corrected on the basis of a difference between a speed at which the transportation unit transports the recording medium and a speed at which the winding unit winds up the recording medium.

* * * * *